US006626018B2

(12) United States Patent
Eller et al.

(10) Patent No.: US 6,626,018 B2
(45) Date of Patent: Sep. 30, 2003

(54) HIGH STRENGTH LEVER HANDLE LOCK MECHANISM

(75) Inventors: Darren C. Eller, East Lyme, CT (US); David A. Sorensen, Hamden, CT (US); Todd C. Zimmer, Meriden, CT (US)

(73) Assignee: Sargent Manufacturing Company, New Haven, CT (US)

( * ) Notice: Subject to any disclaimer, the term of this patent is extended or adjusted under 35 U.S.C. 154(b) by 15 days.

(21) Appl. No.: 09/772,268

(22) Filed: Jan. 29, 2001

(65) Prior Publication Data

US 2002/0100301 A1 Aug. 1, 2002

(51) Int. Cl.[7] ..... E05B 13/10

(52) U.S. Cl. ..... 70/224; 70/134; 70/217; 70/467; 70/475; 70/478; 292/169.15; 292/169.17

(58) Field of Search ..... 70/134, 224, 217, 70/467, 471, 478, 475, 484, 462; 292/167, 336.3, 337, 165, DIG. 64, 169.14, 169.15, 169.16, 169.17, 169.22, 169.23

(56) References Cited

U.S. PATENT DOCUMENTS

| | | | | |
|---|---|---|---|---|
| 1,249,472 | A | * 12/1917 | Painter et al. | |
| 1,739,710 | A | * 12/1929 | Clark | |
| 1,755,434 | A | * 4/1930 | Ellingson | |
| 2,211,130 | A | * 8/1940 | Knapp | |
| 2,912,846 | A | * 11/1959 | Schweitzer | |
| 2,998,274 | A | * 8/1961 | Russell | |
| 3,157,042 | A | * 11/1964 | Wolz | |
| 3,343,860 | A | * 9/1967 | Kohler | |
| 3,708,191 | A | * 1/1973 | Hegedus | 292/1 |
| 3,954,292 | A | * 5/1976 | Johnson | 292/169.17 |
| 4,236,396 | A | * 12/1980 | Surko, Jr. et al. | 70/107 |
| 4,564,229 | A | * 1/1986 | Mullich et al. | 292/169.13 |
| 4,575,137 | A | * 3/1986 | Jans | 292/169.14 |
| 4,641,866 | A | * 2/1987 | Haeck et al. | 292/336.3 |
| 4,641,867 | A | * 2/1987 | Geringer et al. | 292/336.3 |
| 4,869,083 | A | * 9/1989 | DeMarseilles et al. | 70/224 |
| 5,265,924 | A | * 11/1993 | Kim | 292/336.3 |
| 5,269,162 | A | * 12/1993 | Robida et al. | 70/224 |
| 5,421,178 | A | * 6/1995 | Hamel et al. | 70/224 X |
| 5,727,406 | A | 3/1998 | Banducci | 70/224 |
| 5,983,683 | A | * 11/1999 | Shen | 70/224 |
| 6,101,856 | A | 8/2000 | Pelletier et al. | 70/472 |

FOREIGN PATENT DOCUMENTS

| | | | |
|---|---|---|---|
| FR | 1505609 | * 11/1967 | 70/80 |

OTHER PUBLICATIONS

Sargent Manufacturing Company, *8Line Parts List.* pp 8.1 and 8.2.

* cited by examiner

*Primary Examiner*—Lloyd A. Gall
(74) *Attorney, Agent, or Firm*—DeLio & Peterson, LLC

(57) ABSTRACT

A lock mechanism for use with lever handles includes a lock core and a latch mechanism that is rigidly connected to the lock core to prevent the lock core from rotating in the door. Through-bolts are not needed, allowing a small diameter rose to be used. Stops and a spring return mechanism are entirely located within the lock core, allowing the rose to be thin. The lock core defines the rest position for the lever handles at an angle slightly above horizontal. To avoid the necessity for producing different locks in left and right-hand configurations, the lock core is made substantially symmetrical about a vertical plane, instead of a horizontal plane, and the inner and outer sides of the lock mechanism can be interchanged. A heavy-duty locking piece, including a pair of locking lugs that directly engage the lock core near its inner perimeter, allow the lock to withstand abusive forces applied through the lever handle. Endplay is nearly completely eliminated to provide a quality feel through the use of collars that connect the interchangeable inner and outer sides of the lock to the lock core.

20 Claims, 3 Drawing Sheets

HIGH STRENGTH LEVER HANDLE LOCK MECHANISM

BACKGROUND OF THE INVENTION

1. Field of the Invention

The present invention relates to cylindrical locks of the type installed in bored openings in a door. More particularly, the present invention relates to the highest quality and strongest locks of this type designed for use with lever handles where abusive mechanical loads can be applied to the lock mechanism through the lever handle.

2. Description of Related Art

Doors are much easier to open when the door handle is shaped as a lever handle rather than a conventional round knob. For this reason, lever handles are preferred in some applications, and they may be required under applicable regulations for certain doors in public buildings to facilitate access by the disabled and the elderly.

However, the lever shape of the door handle allows much greater force to be applied to the internal locking mechanism of the door than can be applied with a round knob. In most door locks, the lock mechanism prevents the knob from being turned when the door is locked. When a round door knob is replaced by a lever handle, the greater leverage available from a lever handle may allow a vandal or thief to break the internal components of the lock mechanism by standing or jumping on the lever end of the handle. This problem is particularly acute for cylindrical locks, which have less internal room than mortise type locks to accommodate heavy-duty locking components.

Another problem relates to the unbalanced shape of a lever handle, which tends to cause the lever handle to droop. A conventional round doorknob is balanced around the rotational axis of the handle. Thus, it takes relatively little force to return the handle to the rest position. This return force is usually provided by the latch rod return springs in the lock. A lever handle, however, requires much more force to return it to the level position. Sufficient force cannot be provided by the latch rod return springs, so most lever handle designs incorporate auxiliary lever handle return springs.

Because the lever handle return springs are large, and because there is limited space inside the lock, the auxiliary lever handle support springs have heretofore been located in the rose. While this is effective, locating the lever handle return springs in the rose produces a thick rose that is considered by some to be relatively unattractive.

The visual symmetry of a round doorknob means that it is not critical that the knob return exactly to the rest position when the handle is released. However, if a lever handle does not fully return to the level rest position, it appears to droop.

Such visual droop is particularly objectionable. A rest position that is slightly above level, however, is generally not considered to be objectionable.

To avoid visual droop, as a result of normal wear or component tolerances, it would be desirable for the rest position of the lever handle to be slightly above horizontal. However, heretofore it has been difficult to arrange for the lever handle to return to a position above level without constructing the lock in two different versions for left-hand swing and right-hand swing doors or without placing the stops in the rose.

A conventional lock can be installed in either a left-hand swing or a right-hand swing door by flipping the lock top for bottom. This keeps the locking side of the lock mechanism on the same side of the door, while allowing for both the left-hand swing and right-hand swing operation. If the stop position were to be located in the lock mechanism, however, this rotation about a horizontal axis would cause the above-level stop position to reverse to an objectionable below-level position. Requiring separate locks for left and right-hand swing doors, however, is undesirable as it increases inventory costs and results in confusion and delay when the wrong lock is ordered.

Accordingly, the stops are usually placed in the rose. This allows the rose to be reversed relative to the lock body, as needed to always keep the top of the rose at the top regardless of whether the lock is installed in a left-hand or right-hand swing door. Placing the stops in the rose, however, is undesirable as it requires that the rose be made thick to accommodate the stops.

When the rose is used to provide the stops to limit handle motion and to house the return springs, it is necessary to anchor the rose relative to the door. Usually this is done with through-bolts, which connect roses on opposite sides of the door and pass outside of the main hole for the lock body. Through-holes, however, require a large diameter rose to cover these holes. Such a large diameter rose is considered by some to be unattractive and the large diameter increases the cost of the rose.

Another problem with prior art lever handle cylindrical locks arises as a result of the method used to attach the handle to the lock mechanism. Generally, the handle slides over a shaft and is captured by a spring loaded capture piece. The capture piece must have some clearance from the hole that captures it, and this clearance allows axial motion between the shaft and the handle. This motion is perceived as a "loose" handle by the user and is undesirable. Often, there is also some relative motion between the shaft and the lock mechanism as well, which contributes additional objectionable axial motion between the handle and the door. It is highly desirable to reduce or eliminate this axial endplay between the handle and the lock mechanism.

Bearing in mind the problems and deficiencies of the prior art, it is therefore an object of the present invention to provide a lock mechanism for use with lever handles that is strong and resistant to abuse.

It is another object of the present invention to provide a lock mechanism for use with lever handles that does not require boring through-holes.

A further object of the invention is to provide a lock mechanism for use with lever handles that uses thin and small diameter rose plates.

It is yet another object of the present invention to provide a lock mechanism for use with lever handles that has reduced endplay between the handle and the lock body.

It is still another object of the present invention to provide a lock mechanism for use with lever handles that can be more completely disassembled and repaired in the field.

Still other objects and advantages of the invention will in part be obvious and will in part be apparent from the specification.

SUMMARY OF THE INVENTION

The above and other objects, which will be apparent to those skilled in art, are achieved in the present invention, which is directed to a lock mechanism that includes a lock core with a bearing that fits into a first opening bored through the faces of a door and a latch mechanism that fits into a second opening bored perpendicularly from the edge of the door into the first opening.

The latch mechanism includes a latch bolt frame adapted to fit within the second opening. The latch bolt frame is removably attached to the lock core with a rigid connection. The rigid connection between the latch bolt frame and the lock core prevents rotation of the lock core relative to the door. This provides an extremely robust anchor between the lock core and the door so that through-bolts are not required. Because through-bolts are not needed, the rose can have a small diameter, producing a pleasing external appearance for the lock mechanism.

The latch bolt frame may be constructed as a tube enclosing the latch mechanism. The latch bolt frame is sufficiently robust to prevent significant rotation of the lock core during the application of 1000 inch-pounds of torque to the lock core by the lever handle.

The latch mechanism includes a latch bolt, which slides axially inside the latch bolt frame between extended and retracted positions. A sleeve is mounted in the bearing of the lock core, perpendicular to the latch bolt frame. The sleeve includes a shaft portion that extends outward from the bearing and a lever handle is mounted thereon. The sleeve is operatively connected to the latch mechanism to move the latch bolt between the extended and retracted positions as the sleeve is rotated by the lever handle.

A locking piece is mounted in the sleeve so that it can slide axially from a locked position to an unlocked position. The locking piece includes at least one locking lug, and preferably two locking lugs that project radially outward from the sleeve. The locking lugs engage the lock core in the locked position to prevent the lever handle and sleeve from rotating relative to the lock core. By making the locking lugs robust and extending them outward beyond the radius of the sleeve, the forces on them are reduced and they are able to withstand significant abuse, as compared to prior art designs.

In the preferred embodiment of this invention, the locking piece includes a latch driver at an end thereof. The handle turns the sleeve, the sleeve turns the locking piece and the locking piece turns the latch driver. The latch driver forms the operative connection between the sleeve and the latch mechanism by engaging the latch mechanism to drive the latch bolt when the locking piece is in the unlocked position. The latch driver disengages from the latch mechanism when the locking piece is in the locked position.

In the most highly preferred design, the locking piece also includes a key driven piece extending through the locking piece. The key driven piece engages the latch mechanism when the locking piece is in the locked position to allow the latch rod to be retracted by a key while the locking piece remains in the locked position.

Inside the lock core is a spring return for returning the lever handle to a level position, or, more preferably, to slightly above level. The spring return includes a plurality of coil springs, preferably two on each side of the lock core. The coil springs are located in curved contact with an inner surface of the cylindrical lock core. Thus, no portion of the spring return mechanism needs to be located within the rose. This allows the rose to be very thin to provide a pleasing appearance for the lock mechanism.

To provide the strongest construction, the latch bolt frame extends completely through the lock core. In this aspect of the invention, the spring return includes four coil springs organized into two pairs. The pairs of coil springs are located on opposite sides of the latch bolt frame, but still within the lock core.

To reduce the angular distance that the lever handle must be turned, while permitting complete retraction of the latch bolt, the latch mechanism is constructed with a retractor mechanism that retracts the latch bolt and a latch retraction amplifier comprising a retractor arm pivotally attached to the latch bolt frame at one end thereof and contacting the latch bolt at an opposite end thereof. A retractor link extends between the retractor mechanism and the retractor arm. The link acts upon the retractor arm to amplify the linear motion of the latch rod such that the latch bolt moves to the completely retracted position when the lever handle is rotated by no more than forty-five degrees.

The lock core defines an angular mounting orientation of the lever handle relative to the lock core when the lever handle is at rest. The latch bolt frame engages the lock core at an angle less than 180 degrees relative to the angular mounting orientation of the lever handle on the lock core. In this way, the lever handle is held at an angle greater than zero above horizontal when the latch bolt frame is horizontal.

In another aspect of the present invention, endplay is eliminated from the connection of the handles to the lock. To accomplish this, the lever handle is securely mounted on the shaft portion of the sleeve to prevent axial motion of the lever handle relative to the sleeve. The sleeve includes an enlarged portion having a diameter greater than an inner diameter of the bearing receiving the sleeve. The enlarged portion of the sleeve is held in contact with a face surface of the bearing by a retaining collar. The enlarged portion of the sleeve cooperates with the face surface of the bearing to prevent axial motion of the sleeve relative to the lock core.

In still another aspect of the present invention, the retaining collar is provided with one or more lock notches, one of the lock notches engages a lock pin to prevent the retaining collar from being removed. In the preferred embodiment of the invention, the lock pin includes a head and the lock core includes a recess that receives the head of the lock pin. This allows the retaining collar to be tightened into position on the lock core. The head of the lock pin is then extended outward from the recess in the lock core and into engagement with the lock notch in the retaining collar after the retaining collar has been tightened.

In yet another aspect of the present invention, the lock core includes a cylindrical center core and a pair of bearing caps. Each of the bearing caps includes a bearing. The bearing caps are connected to the lock core with removable fasteners to allow the lock core to be disassembled.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–7 of the drawings in which like numerals refer to like features of the invention.

Figure 2:
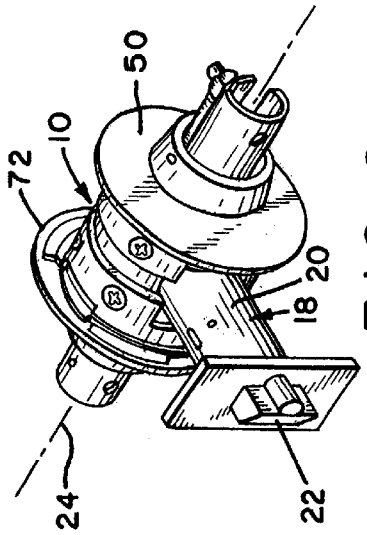
FIG. 2 is a perspective view of the present invention showing the components of FIG. 1 in their assembled configuration. The lever handles are not shown so that the other assembled components can be seen more clearly.
Figure 1:
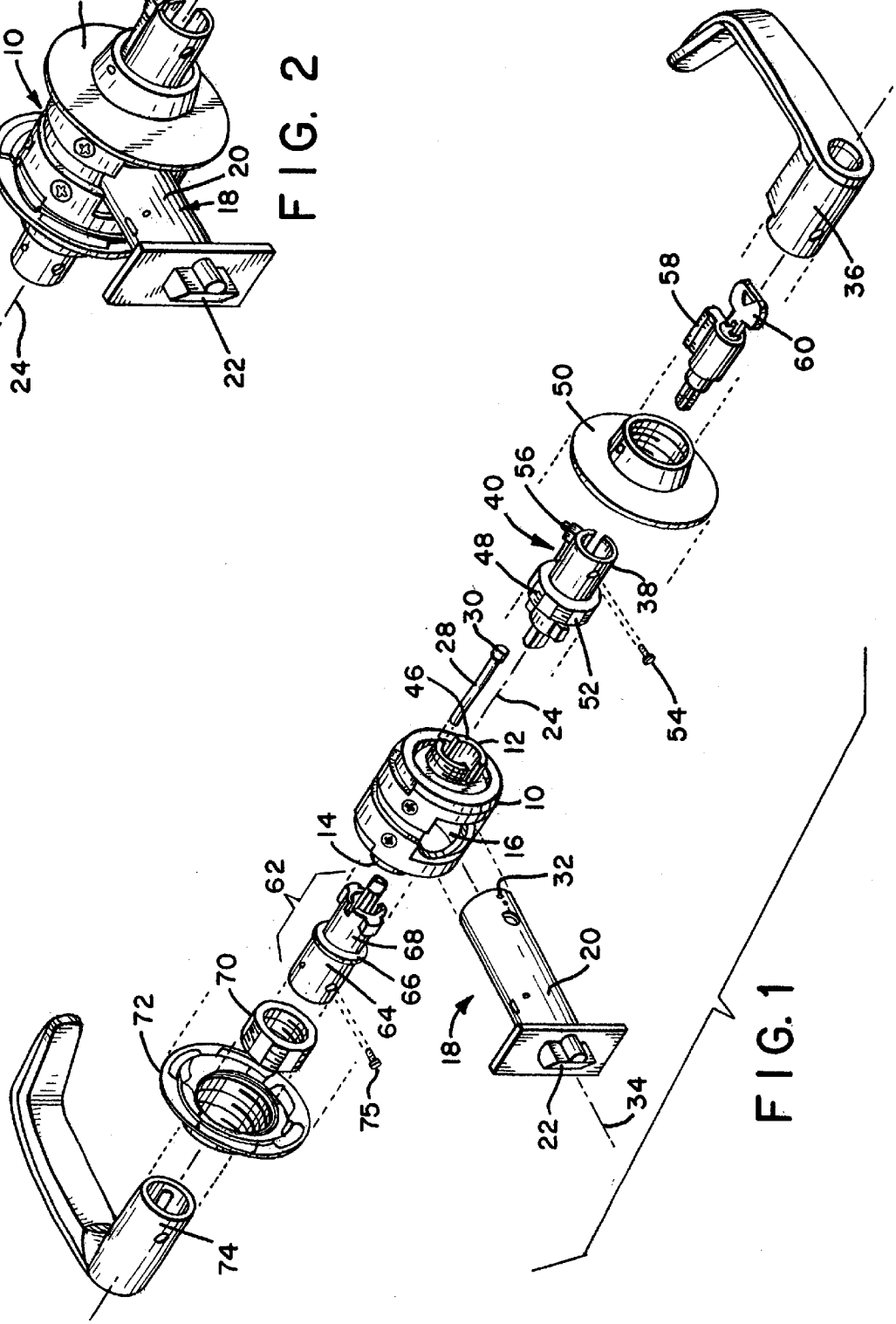
FIG. 1 is a partially exploded perspective view showing major components of the present invention. These are the principal component subassemblies that are provided from the factory and fitted together during installation.

Referring to FIGS. 1 and 2, the present invention includes a lock core 10 having two externally threaded bearings 12, 14 on opposite sides. The lock core 10 includes a front opening 16 that receives a latch mechanism 18 including a latch bolt frame 20 formed in the shape of a tube. The latch mechanism 18 includes a latch bolt 22 and a retractor mechanism 102 (see FIGS. 6 and 7) located within the latch bolt frame 20 for retracting the latch bolt.

Figure 3:
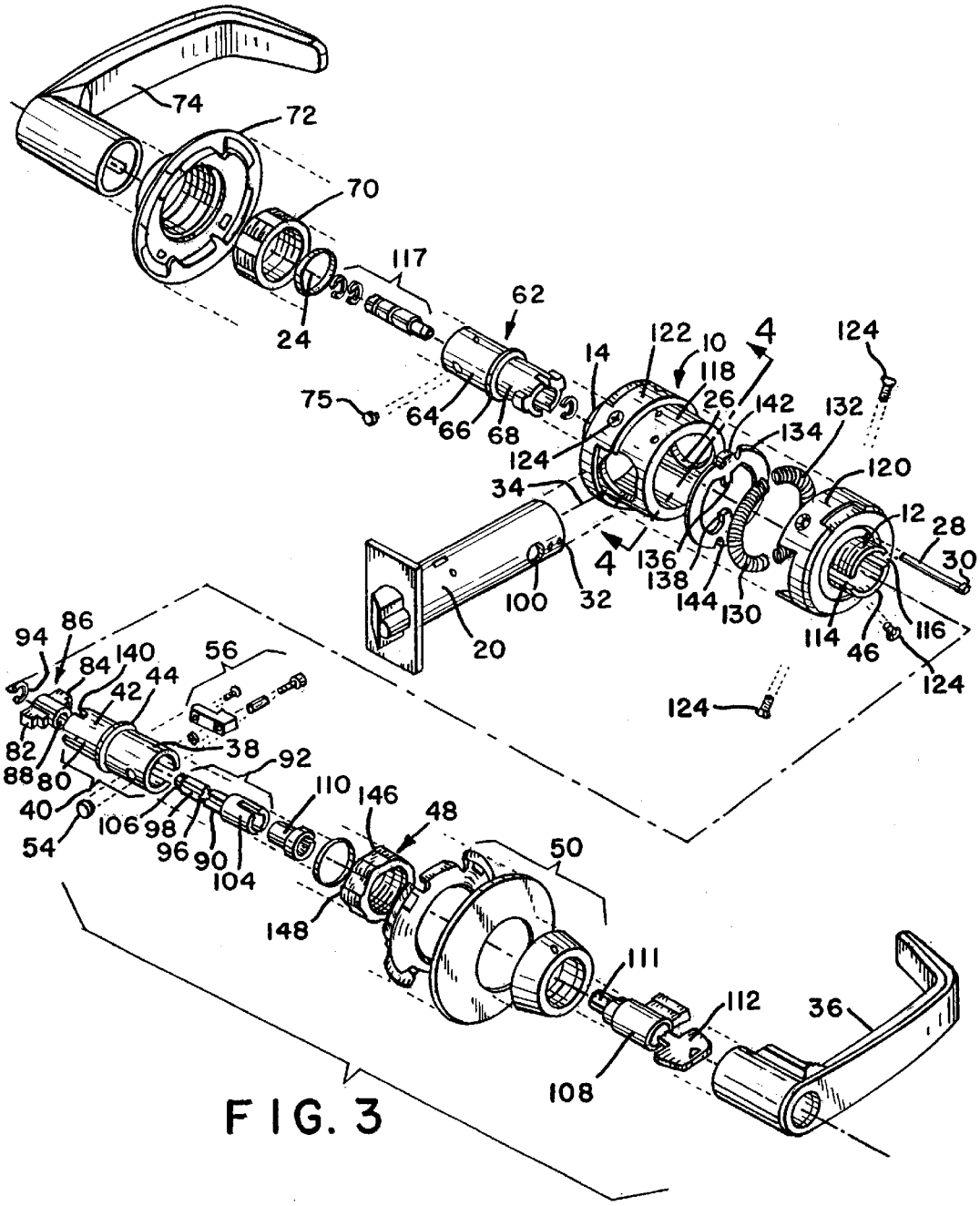
FIG. 3 is a more completely exploded view of the present invention shown in FIG. 1.
Figure 4:
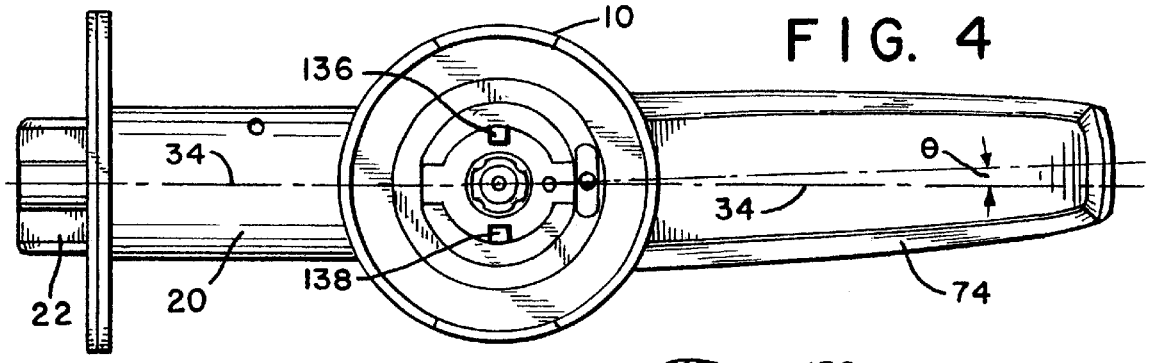
FIG. 4 is a view taken from the side along line 4—4 in FIG. 3 showing the upward angle of the lever handles relative to horizontal.
Figure 5:
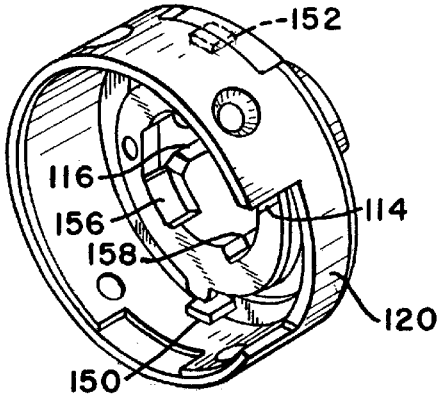
FIG. 5 is a perspective view of a bearing cap from the front inner side.

The tube comprising the latch bolt frame 20 extends through opening 16 in the front of the lock core 10, across the centerline 24, and into engagement with a second opening 26 in the back of the lock core (see FIG. 3). A lock pin 28 with an enlarged head 30 extends through the lock core 10 and through hole 32 in the back of the latch bolt frame to securely hold the latch mechanism 18 in the lock core 10. FIG. 2 shows this assembled construction.

The axis 34 of the latch bolt mechanism and the axis 24 of the handles and lock core define a "T" shape. The latch bolt frame 20 rigidly engages the lock core 10 and extends outward from the cylindrical lock core to prevent rotation of the lock core 10 relative to the opening in the door in which it is installed. The lock core 10 is conventionally installed in an opening bored perpendicularly between the two faces of the door. The latch mechanism 18 is also installed in the conventional manner into a smaller hole drilled perpendicularly from the edge of the door into the larger opening.

Both the latch bolt frame and the lock core are ruggedly constructed. In particular, the tubular latch bolt frame cannot bend easily. Accordingly, the extension of the latch bolt frame out of the lock core, the rugged construction, and the extension of the latch bolt frame entirely through the lock core into pinned engagement with the back of the lock core, all cooperate to create a compact connection between the door and the lock mechanism. This arrangement makes the lock core highly resistant to rotation within the door and allows the forces applied to the lock mechanism during abuse to be transferred from the handle to the lock core and from there directly to the door. This eliminates the need for separate through-bolts, which are normally used in high quality lever handle locks to resist the abusive forces that can be applied to the lever handle.

The outside handle 36 is mounted on the shaft portion 38 of a sleeve 40. An inner portion of sleeve 40 rotates inside bearing 12 (see FIG. 3). The inner portion 42 and the shaft portion 38 of the sleeve 40 are separated by an enlarged portion 44, which has a diameter greater than the inside diameter of bearing 12.

The inner portion of sleeve 40 slides into its bearing 12 until the enlarged portion 44 contacts face surface 46 of the bearing 12. The sleeve 40 is held in its bearing 12 by an outside retaining collar 48.

The outside retaining collar is threaded internally so it can be threaded onto the external threads of bearing 12. The outside retaining collar 48 holds the enlarged portion 44 of the sleeve 40 in rotational contact with the face surface 46 of bearing 12. Retaining collar 48 is provided with external threads (as well as internal threads) so that rose 50 (which is internally threaded) can be threaded onto its exterior. Outside collar 48 is provided with flats 52 so that it can be tightened with a wrench without damaging the external threads. The collar is tightened sufficiently to hold sleeve 40 with the desired pressure against the face surface 46 of bearing 12. This design completely eliminates axial motion of the sleeve 40 relative to the lock core 10.

The outer handle 36 is held to the shaft portion 38 of sleeve 40 by a setscrew 54 and by a spring retaining mechanism 56. The spring retaining mechanism 56 cooperates with the lock cylinder 58 to prevent the handle 36 from being removed if key 60 is not inserted into the lock cylinder and turned. Setscrew 54 prevents the handle 36 from moving axially relative to the shaft portion 38. The setscrew eliminates endplay between the handle 36 and the lock core 10, providing a quality feel for the lock mechanism. The spring retaining mechanism 56 and the lock cylinder 58 cooperate to prevent the lever handle 36 from being removed without the key.

The inner side of the door is similar, and includes an inner sleeve 62 having an inner sleeve portion 64, an enlarged portion 66 and an inner portion 68 that fits inside of bearing 14. An inner collar 70 is internally threaded to engage the external threads on bearing 14 and is externally threaded to receive inner rose 72. Inner handle 74 fits over shaft portion 64 of inner sleeve 62. Setscrew 75 threads into inner handle 74 to hold the inner handle on the inner sleeve 62 and eliminate endplay.

In a conventional design, the lock core comes preassembled with the inner and outer shafts. The outer shaft must always be located on the locked side of the door. Accordingly, a conventional lock core is not symmetrical about a vertical plane through the center of the lock between the two halves. However, conventional designs are substantially symmetrical about the horizontal plane through the center of the lock. The horizontal symmetry allows the lock core to be flipped top for bottom for installation in either a right hand swing or a left hand swing door. This symmetry is important in producing a single lock that can be installed in both right-hand and left-hand swing doors.

The present invention, however, differs significantly. It is designed so that the lock core 10 is not symmetrical about the horizontal plane, but, instead, is substantially symmetrical about the vertical plane. To change the present lock mechanism for right-hand or left-hand installation, the lock core 10 is rotated about its vertical axis, instead of the horizontal axis. In a prior art design, this rotation would change the inside and outside of the lock because the inside and outside are fixed relative to the lock core.

To prevent this reversal in the present design, the inner sleeve 62 and outer sleeve 40 are removable. The inside and outside of the lock mechanism can be reversed by removing the collars 48 and 70 and their associated sleeves 40, 62 to which the inner and outer handles are attached. This change in basic symmetry from the horizontal plane of the prior art to the vertical plane allows the stops for the handles to be located inside the lock core, instead of in the rose, while retaining the feature that the rest position of the handles is slightly upwardly elevated. As can be seen best in FIG. 4, the lock core 10, and the stops inside the core which define the rest position of the handles, are rotated slightly relative to the centerline 34 of the latch mechanism 18 such that the centerlines of the lever handles 36 and 74 are angled upward relative to horizontal by the angle θ, which is preferably about one or two degrees, and most preferably less than three degrees. Unlike prior art designs, in the present invention it is the lock core which defines the angular mounting orientation of the lever handle when it is at its rest position. The angle between centerline 34 of the latch bolt frame where it enters the lock core and the centerline of the lever handles is less than 180 degrees by the small angle θ.

The lock core 10 is always installed with the same surface at the top regardless of whether it is installed in a right hand swing or a left hand swing door. The inner and outer handles, roses, collars and sleeves can be installed on either side of the lock core to make either side the outside.

When the lock mechanism is unlocked, rotating lever handle 36 rotates sleeve 40. As can be seen in FIG. 3, sleeve 40 includes slot 80, which extends perpendicularly across inner portion 42 of the sleeve. Slot 80 receives lugs 82 and 84 on locking piece 86. The lugs project outwardly from the sleeve 40 and are guided by slot 80.

The slot 80 allows locking piece 86 to slide axially inside the sleeve 40 between a locked position and an unlocked position. The locked position for the locking piece positions the locking piece close to handle 36. In the unlocked position, locking piece 86 is located at the far end of the sleeve 40 from the handle 36.

Because sleeve 40 cannot turn relative to the handle 36, rotation of the handle always rotates locking piece 86. Locking piece 86 includes an internally splined central opening 88 that engages externally splined portion 90 on spline member 92. Spline member 92 fits inside the shaft portion 38 of sleeve 40 and engages splined opening 88 inside locking piece 86. It is held in position by C-ring 94, which fits into ring groove 96. The splined portion 98 extends outward beyond the end of locking piece 86 to engage a corresponding splined opening 100 (see FIGS. 6 and 7) to operate retractor mechanism 102 inside the latch mechanism 18. Splined portions 90 and 98 form a single piece comprising a latch driver that always moves and rotates with locking piece 86. Extending through the center of these two splined portions 90, 98, however, is a shaft connecting key end 104 to splined end 106. These two ends comprise a single key driven piece that always moves axially with the latch driver piece and the locking piece 86. However, the key driven piece is free to rotate as a unit relative to the locking piece and to the latch driver. Key end 104 is driven by cylinder lock 108 through connecting piece 110 and the key tailpiece 111. When key end 104 is rotated, splined end 106 is also turned.

When the locking piece 86 is in the unlocked position, splined portion 98 engages splined opening 100 in the retractor mechanism so that rotation of the handle will operate the retractor mechanism. When the locking piece 86 moves outward to the locked position, splined portion 98 is withdrawn from splined opening 100. In this position, only splined end 106 engages the splined opening 100 and the latch may be retracted by rotating key 112.

The axial motion of locking piece 86 between the inward (unlocked) position and the outward (locked) position causes the locking lugs 82 and 84 to engage and disengage the corresponding locking lug slots 114, 116.

From the description above, the complete locking action can now be described. The lock mechanism is locked by sliding the locking piece 86 outward to the locked position. The locking piece can be moved to this position from the outside of the lock by the lock cylinder 108 and key 112 or from the inside by the button mechanism 117. As the locking piece moves outward, it simultaneously disengages splined portion 98 from the splined opening 100 in the retractor and moves the two heavy-duty locking lugs into engagement with the locking lug slots 114, 116 in the lock core. Thus the locking lugs connect the lever handle 36 to the lock core, so that the rugged "T" design can prevent rotation as the handle is disengaged from the retractor.

As can be seen in FIG. 3, the lock core 10 includes a center core piece 118 and two bearing caps 120, 122, which incorporate bearings 12 and 14 respectively.

The bearing caps 120, 122 are held on the center core 118 with screws 124. There are preferably four screws on each bearing cap. Unlike conventional lock designs, which are not easily disassembled or repaired in the field, by removing the screws, the lock core of the present design can be almost completely disassembled.

The outer bearing cap 120 encloses a pair of springs 130, 132 and a spring driver 134. The outer bearing cap 120 is shown in detail in FIG. 5. The spring driver includes two inwardly directed fingers 136, 138, which engage corresponding notches on the outer sleeve 40. Finger 136 engages notch 140 on sleeve 40 so that rotation of the handle 36 also rotates spring driver 134.

Spring driver 134 also includes a pair of axially extending tabs 142 and 144, which drive coil springs 130 and 132. The coil springs 130 and 132 lie in channels formed in the inside perimeter of each bearing cap and are trapped between two corresponding spring stops 150, 152 (see FIG. 5). The spring stops are located at the top and bottom inside the bearing caps. The springs 130, 132 exert a force between the spring stops 150, 152 and the tabs 142, 144 on the spring driver to bring the tabs into alignment with the spring stops.

Rotation of the spring driver 134 in either direction will compress springs 130 and 132 between a spring stop at one end and a tab at the other end. Thus, the location of the spring stops defines the rest position of the handles. The positions of the spring stops and the rest position of the handles relative to horizontal and the axis 34 of the latch mechanism 18 are set during manufacture by the angle at which the bearing caps are installed on the center core piece 118 before the screws 124 are installed.

In addition to the spring stops, which define the rest position, the bearing caps define and limit the maximum rotation of the lever handles. Preferably this maximum rotation is about 45 degrees up and 45 degrees down. The limit stops are provided by two limit channels 156, 158 machined into the inside of the bearing caps. The limit channels 156, 158 are immediately adjacent to the locking lug slots 114, 116. When the locking piece moves inward to the unlocked position, the locking lugs 82, 84 move out of the locking lug slots 114, 116 and into the adjacent limit channels 156, 158. The channels are sized to permit the lever handles and locking piece to rotate the desired amount. If an attempt is made to rotate the handles beyond the maximum permitted rotation, the locking lugs contact the ends of the limit channels. Any excess force applied at this limit is transferred to the lock core and from there to the door through the "T" design of the lock. This protects the internal lock mechanism from excess force applied in the unlocked position as well as in the locked position.

A substantially identical arrangement is found within the opposite bearing cap 122, which includes a corresponding spring driver and pair of coil springs. It will be understood from this description that the lock core includes the stops and the spring return mechanism necessary for the return of the lever handles 36 and 74 to the rest position on the stops. It can also be seen that when the lock mechanism is locked, by sliding lock piece 86 towards handle 36, the locking lugs 82 and 84 engage bearing cap 120. Locking lugs 82 and 84 also act against stops in the interior of the lock core.

This mechanism is unlike prior art designs in that the stops and the spring return mechanism are completely located within the lock core and not within the rose assemblies 50 or 72. The locking mechanism is extremely robust because the locking lugs 82 and 84 project outward from the sleeve into contact with the bearing cap. Thus, the force resisting rotation is transferred through a heavy-duty machined sleeve to a heavy-duty, two lug, locking piece and from there to the lock core. The transfer of force from the locking piece to the core is done at the outer perimeter relative to the sleeve 40. Because the locking lugs project out from the perimeter of sleeve 40, the force on the locking mechanism is reduced as compared to prior art designs that locate the locking mechanism entirely within the rollup spindle, which roughly corresponds to the sleeves 40, 62 of the present design.

The rotation of the lock core 10 within the door is resisted by the "T" design of the latch bolt frame 20 which extends completely through the lock core. The combination of heavy-duty lock core, "T" design and locking lugs that transfer force at a relatively large distance from the centerline of the lock produces a very secure locking mechanism, which is extremely resistant to abuse. The locking mechanism will easily resist the application of 1000 inch pounds of torque to the sleeve by the lever handle without damage. Torque in excess of this will not cause the lock to open. Consequently, it is not necessary to provide through-bolts from the rose 50 to the rose 72, which pass outside the outer perimeter of the opening receiving the lock core 10. Because through-holes and through-bolts are not required, the roses 50, 72 can be thin and have a small diameter. This produces an attractive lock mechanism design, as compared to prior art designs which incorporate the spring return mechanism and through-bolts in the rose.

The outer components of the lock, including the outer handle 36 and lock cylinder 58 are mounted on the outer sleeve 40. To prevent these components from being removed by removing the collar 48, the outer collar 48 is produced with one or more sets of locking notches 146 and corresponding oppositely directed locking tabs 148 that produce a castellated edge on the outer collar 48 where it abuts the surface of the outer bearing cap 120. The locking notches are sufficiently deep to receive the head 30 of the locking pin 28.

The shaft of the locking pin is slightly longer than the width of the assembled lock core 10. Because the inner collar 70 does not include the castellated edge, when it is installed, it forces the head 30 of the locking pin 28 to protrude up from the surface of the outer bearing cap 120. That surface has a recess that initially allows the head 30 of the locking pin 28 to lie just below the plane of the surface where the outer collar 48 will abut it.

To assemble the mechanism, the lock core 10 is inserted into its opening in the door. It is important that the lock core 10 be inserted with its correct side to the top so that the stops are oriented to produce the desired slight upward angle for the handles when they are at the rest position. The latch mechanism 18 is then inserted into its opening in the door and pushed into opening 16 in the lock core and though to the back side, where it is seated in the second opening 26 in the back of the lock core. Pin 28 is then pushed into the lock core from the outer side of the door and through the back of the latch bolt frame 20 to lock it into place.

Pin 28 is pushed inward until the head 30 lies below the surface of the outer bearing cap 120. Because either side of the door may become the locked side, both sides of the lock core 10 are provided with a recess to receive the head 30 of the pin 28.

The outer sleeve 40 is then inserted into the outer bearing, i.e., on the same side as the head 30 of the pin 28. The bearings 12 and 14 are identical, and both will accept either locking collar, depending on whether a right or left-hand swing door is desired. Next, the outer collar 48 is threaded on and tightened until locking tabs 148 contact the surface of the outer bearing cap 120. The tabs can pass over the head 30 because it lies below the surface. Once the outer collar is tightened, the inner sleeve 62 is installed in the remaining bearing. As the inner collar 70 is tightened, it contacts the end of pin 28 and pushes the head 30 up out of its recess and into locking engagement with locking notch 146 in the castellated edge of the outer collar. This prevents the outer collar from being removed.

The outer and inner roses 50 and 72 are then attached, followed by the handles. Last, the setscrews 54, 75 are tightened to completely eliminate endplay. A conventional knob handle is normally designed to retract the latch bolt with a rotation greater than 45 degrees. The present invention will also operate with such greater rotation angles by increasing the angular size of the limit channels. A greater rotation angle is comfortable for the user when grasping a round knob and rotating it by rotating the wrist. However, the motion of the hand when operating a lever handle is different and it is not comfortable for a user to have to rotate a lever handle with a rotation angle much greater than 45 degrees.

This lesser angle means that the retraction mechanism must retract the latch bolt more rapidly, i.e., retract it farther per degree of handle rotation, than is required for a knob handle. In the present invention, this requirement is met by a latch retraction amplifier in the latch bolt.

Figure 6:
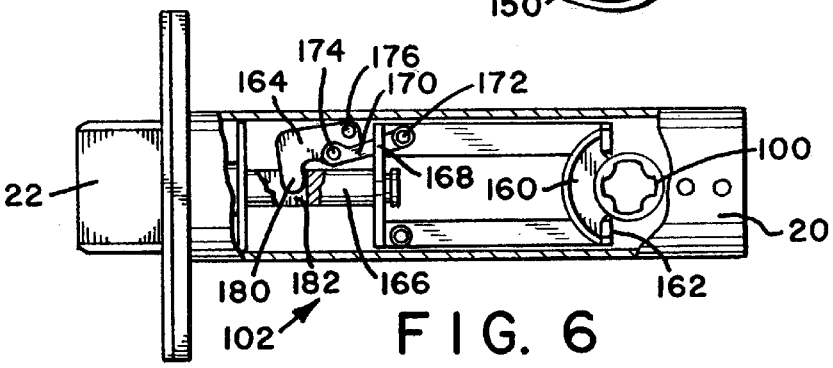
FIG. 6 is a side view of the latch mechanism showing the latch bolt extended. A portion of the latch bolt frame has been cut away to show the latch retractor mechanism.
Figure 7:
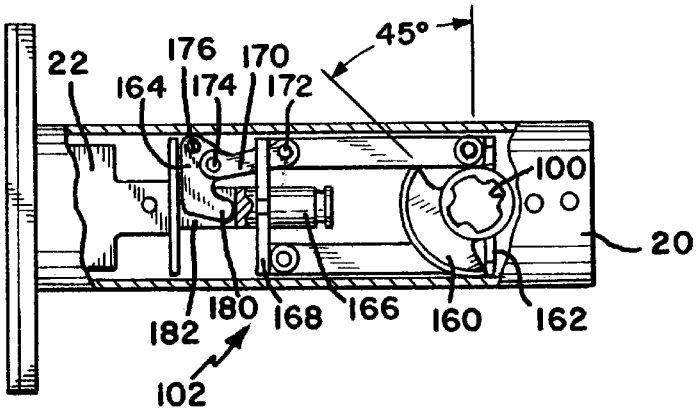
FIG. 7 is a side view of the latch mechanism showing the latch bolt retracted. A portion of the latch bolt frame has been cut away to show the latch retractor mechanism.

Referring to FIGS. 6 and 7, the retractor mechanism 102 comprises a conventional cam 160 having splined opening 100. As in prior art designs, a corresponding second cam and second splined opening are also located within the latch mechanism 18 symmetrically adjacent to the first cam 160 and the first splined opening 100 so that the inner and outer handles can independently retract the latch bolt. When the lever handle 36 is turned, splined portion 98 rotates the cam 160 from the position seen in FIG. 6 to the position seen in FIG. 7. The cam 160 acts upon the tail 162 of the latch bolt 22 to retract it. In a conventional design, this retraction is direct, with the latch bolt head retracting the same distance as the latch bolt tail is moved. However, in the present design, the linear retraction motion of the head is amplified (as compared to the linear retraction motion of the tail) by retractor arm 164.

The latch bolt head 22 includes a shaft 166, which slides in plate 168 of the tailpiece 162. Conventional springs (not shown) keep the latch bolt head extended (as in FIG. 6) relative to the tailpiece 162. These springs and the motion of the head 22 relative to the tail 162 are well known and are needed to allow the latch bolt head 22 to move inward toward the retracted position, as the door swings closed and the latch bolt strikes the door frame, without requiring the handle to move.

In the present invention, during retraction of the latch bolt by the handle, the head and tail do not move as a unit, as in prior art designs. Instead, the retractor arm and a retractor link 170 are interposed between the head and tail portions of the latch bolt. The retractor link 170 is connected between the latch bolt tailpiece 162 and the retractor arm 164. The retractor link 170 is connected to the latch bolt tailpiece 162 with pivot 172 and to the retractor arm 164 with pivot 174.

The retractor arm 164 is connected to the stationary latch bolt frame 20 with pivot 176. The tip 180 of the retractor arm 164 fits inside of slot 182 in the shaft 166. Because the tip 180 of the retractor arm is farther from the fixed pivot 176 than the moving pivot 174 is from the fixed pivot 176, the retraction motion of the tail 162 is amplified and the shaft 166 and head of the latch bolt 22 move to the fully retracted position with significantly less angular rotation of the cam 160 than is required in prior art devices. The retractor link acts upon the retractor arm to amplify the linear motion of the latch rod such that the latch bolt moves to the completely retracted position when the lever handle is rotated by no more than forty-five degrees.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A lock mechanism for mounting in a door, the lock mechanism comprising:

a lock core adapted to fit within a first opening in the door, the lock core including a bearing;

a latch mechanism including:

a latch bolt frame adapted to fit within a second opening in the door, the second opening extending from an edge of the door to the first opening in the door, the latch bolt frame being interlocked with, attached to and rigidly engaging the lock core, the latch bolt frame being engaged by the second opening in the door and the rigid engagement between the latch bolt frame and the lock core acting to prevent rotation of the lock core relative to the door, and a latch bolt axially slidable within the latch bolt frame between extended and retracted positions;

a sleeve rotationally mounted in the bearing of the lock core, the sleeve including a shaft portion extending outward from the bearing and the sleeve being operatively connected to the latch mechanism to move the latch bolt between the extended and retracted positions as the sleeve is rotated;

a lever handle mounted on the shaft portion of the sleeve to rotate the sleeve;

a locking piece slidably mounted in the sleeve, the locking piece sliding axially from a locked position to an unlocked position, the locking piece including at least one locking lug projecting outward from the sleeve, the locking lug engaging the lock core in the locked position to prevent the lever handle and sleeve from rotating relative to the lock core and the latch bolt frame, the locking piece further including a latch driver, the sleeve turning the locking piece and the locking piece turning the latch driver, the latch driver forming the operative connection between the sleeve and the latch mechanism by engaging the latch mechanism to drive the latch bolt between extended and refracted positions when the locking piece is in the unlocked position and the latch driver disengaging from the latch mechanism when the locking piece is in the locked position; and a key driven piece extending through the locking piece, the key driven piece engaging the latch mechanism when the locking piece is in the locked position to allow the latch bolt to be retracted by a key cylinder when the locking piece is in the locked position.

2. The lock mechanism of claim 1 wherein the locking piece includes two locking lugs projecting outward from the sleeve in opposite directions, the locking lugs engaging the lock core in the locked position to prevent the lever handle and sleeve from rotating relative to the lock core and the latch bolt frame.

3. The lock mechanism of claim 1 wherein the latch bolt frame is sufficiently rigidly attached to the lock core to prevent significant rotation of the lock core during the application of 1000 inch-pounds of torque to the sleeve by the lever handle.

4. The lock mechanism of claim 1 wherein the latch bolt frame is a tube.

5. The lock mechanism of claim 1 wherein the lock core includes a spring return, the spring return having sufficient strength to hold the lever handle at or above a level position.

6. The lock mechanism of claim 5 wherein the lock core is substantially cylindrical and the spring return includes a plurality of coil springs, the coil springs being located in curved contact with an inner surface of the lock core.

7. The lock mechanism of claim 5 wherein the latch bolt frame extends through the lock core and the spring return includes four coil springs, the coil springs comprising two pairs of coil springs, the pairs of coil springs being located on opposite sides of the latch bolt frame.

8. The lock mechanism of claim 1 further including a rose, the rose not including any spring return mechanism.

9. The lock mechanism of claim 8 wherein the rose has a smaller diameter than conventional roses used with through-bolted lever handle lock mechanisms.

10. The lock mechanism of claim 1 wherein the lock core defines an angular mounting orientation of the lever handle relative to the lock core when the lever handle is at rest and the latch bolt frame engages the lock core at an angle less than 180 degrees relative to the angular mounting orientation of the lever handle on the lock core, whereby the lever handle is held at an angle greater than zero above horizontal when the second opening in the door and the latch bolt frame are horizontal.

11. The lock mechanism of claim 1 wherein:

the lever handle is securely mounted on the shaft portion of the sleeve to prevent axial motion of the lever handle relative to the sleeve; and the sleeve further includes an enlarged portion having a diameter greater than an inner diameter of the bearing receiving the sleeve, the enlarged portion being held in contact with a face surface of the bearing by a retaining collar, the enlarged portion cooperating with the face surface of the bearing to prevent axial motion of the sleeve relative to the lock core.

12. The lock mechanism of claim 1 wherein the lock core includes a cylindrical center core and a pair of removable bearing caps, a first one of the pair of bearing caps including the bearing and the other bearing cap including a second bearing.

13. The lock mechanism of claim 12 wherein the bearing caps are removable from the lock core and are connected to the lock core with removable fasteners.

14. The lock mechanism of claim 1 wherein the rotational mounting of the sleeve in the bearing of the lock core defines a rotational axis for the lock mechanism and the latch bolt frame extends through the lock core and engages the lock core on opposite sides of the rotational axis of the lock mechanism.

15. A lock mechanism for mounting in a door, the lock mechanism comprising:

a lock core adapted to fit within a first opening in the door, the lock core including a bearing;

a latch mechanism including:

a latch bolt frame adapted to fit within a second opening in the door, the second opening extending from an edge of the door to the first opening in the door, the latch bolt frame being interlocked with, attached to and rigidly engaging the lock core, the latch bolt frame being engaged by the second opening in the door and the rigid engagement between the latch bolt frame and the lock core acting to prevent rotation of the lock core relative to the door, and a latch bolt axially slidable within the latch bolt frame between extended and retracted positions;

a sleeve rotationally mounted in the bearing of the lock core, the sleeve including a shaft portion extending outward from the bearing and the sleeve being operatively connected to the latch mechanism to move the latch bolt between the extended and retracted positions as the sleeve is rotated;

a lever handle mounted on the shaft portion of the sleeve to rotate the sleeve;

a locking piece slidably mounted in the sleeve, the locking piece sliding axially from a locked position to an unlocked position, the locking piece including at least one locking lug projecting outward from the sleeve, the locking lug engaging the lock core in the locked position to prevent the lever handle and sleeve from rotating relative to the lock core and the latch bolt frame;

a retractor mechanism for moving the latch bolt to the retracted position, and a latch retraction amplifier comprising:

a retractor arm pivotally attached to the latch bolt frame at one end thereof and contacting the latch bolt at an opposite end thereof, and a retractor link extending between the retractor mechanism and the retractor arm the sleeve being connected to the retractor mechanism to move the latch bolt to the retracted position when the lever handle is rotated by no more than forty-five degrees.

16. A lock mechanism for mounting in a door, the lock mechanism comprising:

a lock core adapted to fit within a first opening in the door, the lock core including a bearing;

a latch mechanism including:

a latch bolt frame adapted to fit within a second opening in the door, the second opening extending from an edge of the door to the first opening in the door, the latch bolt frame being interlocked with, attached to and rigidly engaging the lock core, the latch bolt frame being engaged by the second opening in the door and the rigid engagement between the latch bolt frame and the lock core acting to prevent rotation of the lock core relative to the door, and a latch bolt axially slidable within the latch bolt frame between extended and retracted positions;

a sleeve rotationally mounted in the bearing of the lock core, the sleeve including a shaft portion extending outward from the bearing and the sleeve being operatively connected to the latch mechanism to move the latch bolt between the extended and retracted positions as the sleeve is rotated, the sleeve further including an enlarged portion having a diameter greater than an inner diameter of the bearing receiving the sleeve, the enlarged portion being held in contact with a face surface of the bearing by a retaining collar, the enlarged portion cooperating with the face surface of the bearing to prevent axial motion of the sleeve relative to the lock core; the retaining collar including a lock notch, the lock notch engaging a lock pin to prevent the retaining collar from being removed;

a lever handle securely mounted on the shaft portion of the sleeve to rotate the sleeve and prevent axial motion of the lever handle relative to the sleeve; and a locking piece slidably mounted in the sleeve, the locking piece sliding axially from a locked position to an unlocked position, the locking piece including at least one locking lug projecting outward from the sleeve, the locking lug engaging the lock core in the locked position to prevent the lever handle and sleeve from rotating relative to the lock core and the latch bolt frame.

17. The lock mechanism of claim 16 wherein the lock pin extends into the lock core.

18. The lock mechanism of claim 16 wherein the lock pin includes a head and the lock core includes a recess for receiving the head of the lock pin to allow the retaining collar to be positioned relative to the lock core, the head of the lock pin extending outward from the recess in the lock core and into the lock notch in the retaining collar after the retaining collar has been positioned relative to the lock core.

19. The lock mechanism of claim 16 wherein the lock pin extends into the latch bolt frame to hold the latch bolt frame relative to the lock core.

20. A lock mechanism for mounting in a door, the lock mechanism comprising:

a lever handle;

a lock core adapted to fit within a first opening in the door, the lock core including an inside bearing and an outside bearing, the bearings being located on opposite sides of the lock core and corresponding to an inside face and an outside face of the door;

a latch mechanism including:

a latch bolt frame adapted to fit within a second opening in the door, the second opening extending from an edge of the door to the first opening in the door, and a latch bolt axially slidable within the latch bolt frame between extended and retracted positions;

a removable outside retaining collar mounted on the outside bearing; and a sleeve rotationally mounted in the outside bearing of the lock core, the sleeve being operatively connected to the latch mechanism to move the latch bolt between the extended and retracted positions as the sleeve is rotated, the sleeve including:

a shaft portion extending outward from the outside bearing, the lever handle being securely mounted on the shaft portion of the sleeve to prevent axial motion of the lever handle relative to the sleeve, and an enlarged portion having a diameter greater than an inner diameter of the outside bearing, the enlarged portion being held in contact with a face surface of the outside bearing by the outside retaining collar, the enlarged portion cooperating with the face surface of the bearing to prevent axial motion of the sleeve relative to the lock core;

the sleeve being removable from the outside bearing by removing the outside retaining collar and the sleeve being insertable into the inside bearing;

an inside retaining collar mounted on the inside bearing; and a lock pin having a head, the lock pin extending through the lock core;

the outside retaining collar including a lock notch, the lock notch engaging the head of the lock pin to prevent the outside retaining collar from being removed;

the lock core including a recess for receiving the head of the lock pin to allow the outside retaining collar to be positioned relative to the lock core; and the inside retaining collar contacting an opposite end of the lock pin from the head of the lock pin to push the head of the lock pin outward from the recess in the lock core and into the lock notch in the outside retaining collar when the inside retaining collar is positioned relative to the inside bearing after the outside retaining collar is positioned relative to the outside bearing.

* * * * *

UNITED STATES PATENT AND TRADEMARK OFFICE

CERTIFICATE OF CORRECTION

PATENT NO. : 6,626,018 B2 
DATED : September 30, 2003
INVENTOR(S) : Darren C. Eller, David A. Sorensen and Todd C. Zimmer It is certified that error appears in the above-identified patent and that said Letters Patent is hereby corrected as shown below:

Column 12,
Line 3, delete "refracted" and substitute therefore -- retracted --.

Signed and Sealed this

Second Day of March, 2004

JON W. DUDAS
*Acting Director of the United States Patent and Trademark Office*